United States Patent [19]

Ritter et al.

[11] 4,215,807

[45] Aug. 5, 1980

[54] INSERTION MEANS FOR FLEXIBLE FILAMENTS

[75] Inventors: Don D. Ritter; Edwin A. Patterson, both of Gastonia; Henry M. Pigg, Mount Holly, all of N.C.

[73] Assignee: Dennison Manufacturing Company, Framingham, Mass.

[21] Appl. No.: 412

[22] Filed: Jan. 2, 1979

[51] Int. Cl.[3] ..... D05B 3/20

[52] U.S. Cl. ..... 227/21; 227/30; 227/67; 227/76; 227/152; 227/154

[58] Field of Search ..... 227/21, 30, 67, 124, 227/152, 154, 76

[56] References Cited

U.S. PATENT DOCUMENTS

| | | | |
|---|---|---|---|
| 3,734,375 | 5/1973 | Bone et al. | 227/67 |
| 3,735,908 | 5/1973 | Kinney et al. | 227/67 |
| 3,872,806 | 3/1975 | Bone | 227/67 |
| 3,875,648 | 4/1975 | Bone | 227/67 |

*Primary Examiner*—John McQuade
*Attorney, Agent, or Firm*—George E. Kersey

[57] ABSTRACT

An assembly for inserting attachment members through thick, bulky goods, the attachments being of the type including two end pieces connected by a thin, flexible filament. The assembly includes a fluid powered fastener inserting device, a receiver cylinder, an air cylinder, and mounting structure. A fastener dispensing needle held in a projectible member is lowered from the fastener inserting device while the receiver cylinder is raised by the air cylinder, compressing the workpiece therebetween. One end of an attachment member is inserted by the needle through the workpiece, and emerges in a cavity of the receiver cylinder, the cavity being configured to minimize stress on the attachment member during this process.

6 Claims, 7 Drawing Figures

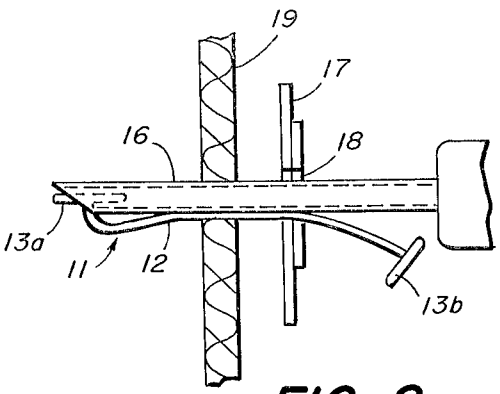
FIG. 2
PRIOR ART
FIG. 1
PRIOR ART
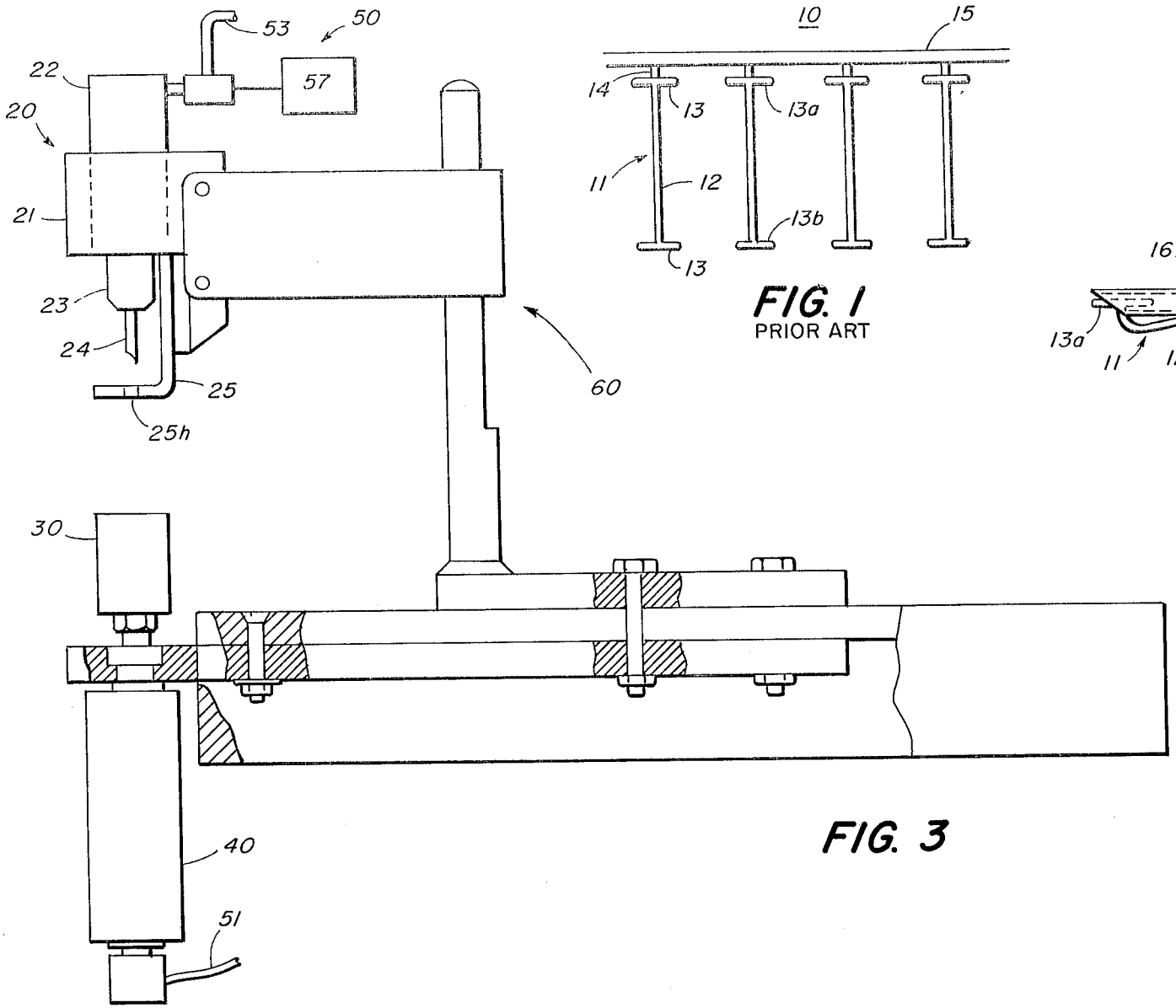
FIG. 3

FIG. 4A
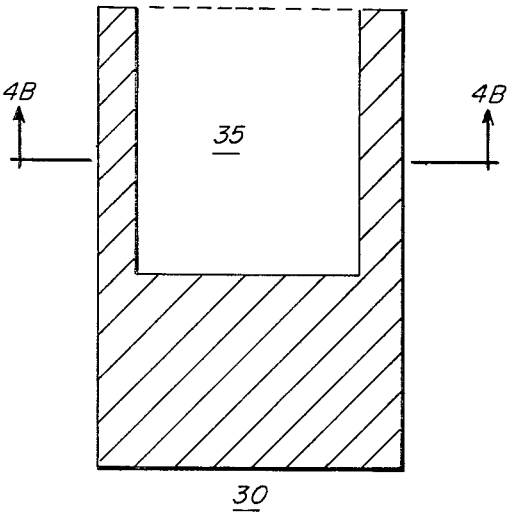
FIG. 4B
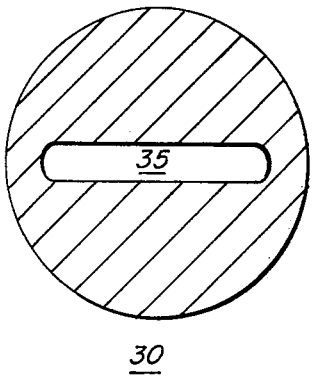
FIG. 4C
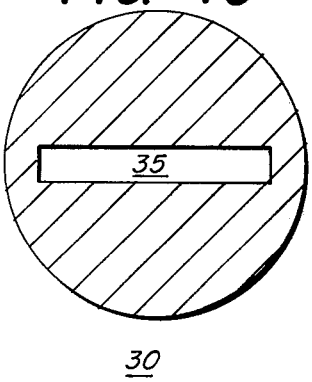
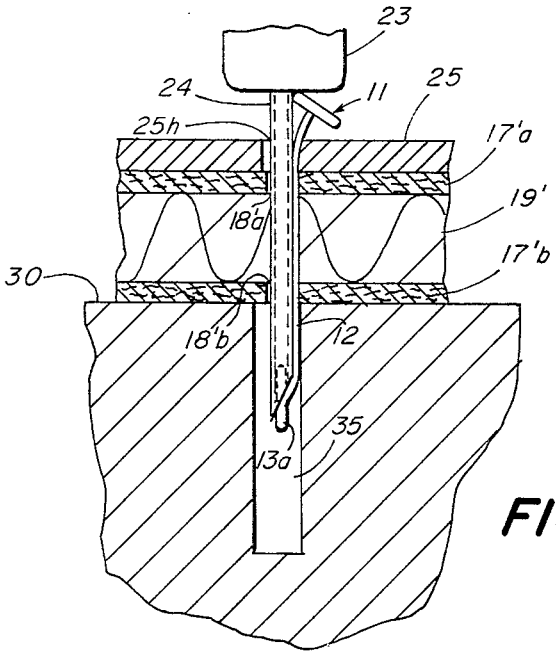
FIG. 5

INSERTION MEANS FOR FLEXIBLE FILAMENTS

BACKGROUND OF THE INVENTION

The present invention relates to powered attaching devices for soft goods, and more particularly means for adapting powered attaching devices to thick, bulky goods.

The attaching apparatus of the present invention accommodates assemblies of attachment members of the well-known type illustrated at 11 in FIG. 1, including a thin flexible filament 12 and two ends 13. These individual attachment members are coupled by neck portions 14 to a bar or rod 15, forming an assembly 10. These attachments may be used for numerous purposes compatible with the insertion of a needle into articles, using attaching devices of the type disclosed, for example, in U.S. Pat. Nos. 3,103,666 and 3,470,834. The attaching process involves the severing of an individual fastener 11 at the neck portion 14, and the insertion of one end 13*a* and the filament 12 through two items to be coupled. Insertion is accomplished by means of a hollow needle through which the attachment member is forced.

FIG. 2 shows a hollow needle 16 which is elongately slotted along one side. To attach a tag, for example, the needle 16 is first inserted through an opening 18 of a tag 17 and then through the weave of fabric 19 to which the tag is to be attached. The end 13 of individual attchment member 11 is then driven through the needle 16 with the filament 12 extending through the needle's slotted side. As the attachment 11 proceeds through the tag 17 and fabric 19, the filament 12 will be bent back parallel to the end 13 as shown in the drawing to permit the passage of the attachment.

U.S. Pat. Nos. 3,734,375 and 3,735,908 disclose improved versions of these earlier attaching devices. These patents disclose a fluid powered attaching device involving the same insertion principle as that of U.S. Pat. No. 3,103,666; the needle is moved pneumatically and fasteners are forced therethrough by similarly powered means.

Particular requirements exist for attaching applications involving abnormally high stresses in the fastening process, as for example the attachment of items to thick goods such as heavy socks. The attaching needle in such applications undergoes significant torque during the penetration of thick goods. This torque, if transmitted to the attachment member to be inserted, is likely to cause the member to fracture, particularly at the junction of filament 12 and one end 13. Of course, the use of internally powered attaching devices is preferable for these applications in order to avoid undue operator fatigue. The fluid powered attaching assemblies of the prior art are inadequate from the above criteria.

Accordingly, it is a principal object of the invention to provide an internally powered attaching device for the attachment type described above. A related object is to minimize operator fatigue for attaching applications involving heavy goods.

Another object of the invention is the avoidance of fastener breakage during the operation of the attaching device. It is undesirable in this regard for attachment members to undergo significant torque during the attaching process.

SUMMARY OF THE INVENTION

In furthering the above and related objects, the powered attaching assembly of the invention provides means for clamping thick, bulky items while inserting a fastener of the above described type. The assembly includes a fastener inserting device which may be fluid powered, a receiver cylinder which is raised and lowered by an air cylinder, a supporting structure, and fluid supply lines and control.

In accordance with a preferred embodiment of the invention, the fastener inserting device includes a projectible member, which houses a fastener dispensing needle. The projectible member is lowered in conjunction with a movable jaw in response to a fluid impulse in the fastener inserting device, and a fastener is forced through the needle by similar means. In accordance with a related aspect of the invention, the receiver cylinder is raised simultaneously with the lowering of the projectible member and movable jaw in conjunction with the motion of a piston within the air cylinder. A workpiece placed upon the receiver cylinder is thereby compressed preparatory to the insertion of an attachment member.

In accordance with another aspect of the invention, the receiver cylinder contains a cavity which allows the incursion of the needle when the projectible member and receiver cylinder converge. The cavity is shaped so as to ensure that an attachment member ejected from the needle will be properly oriented to avoid twisting, minimizing the risk of fracture.

BRIEF DESCRIPTION OF THE DRAWINGS

The above and additional aspects of the invention are illustrated with reference to the foregoing discussion of the prior art, the detailed description of the invention which follows, and the accompanying drawings in which:

FIG. 1 is a plan view of a prior art fastener of the type preferably employed in the invention;

FIG. 2 is a plan view of a needle dispensing a fastener of the general type shown in FIG. 1, in order to attach a tag to fabric in accordance with the prior art;

FIG. 3 is an elevation view of a fluid powered attaching assembly, in accordance with a preferred embodiment of the invention;

FIG. 4A is a cross sectional view of the receiver cylinder of FIG. 3, as seen from the side;

FIG. 4B is a cross sectional view of the receiver cylinder as seen from below, in a section 4B—4B of FIG. 4A;

FIG. 4C is a cross sectional view of an alternate receiver cylinder as seen from above; and FIG. 5 is a fragmentary side sectional view of the fastener dispensing area during the operation of the fluid powered attaching assembly of FIG. 3.

DETAILED DESCRIPTION

Reference should now be had to FIGS. 1 through 5 for a detailed description of the powered attaching assembly of the invention. The assembly, shown in the elevation view of FIG. 3, comprises a fastener inserting machine 20, a receiver cylinder 30, an air cylinder 40, air supply lines and control 50, and a mounting assembly 60.

The fastener inserting machine 20 is advantageously of the type disclosed in U.S. Pat. Nos. 3,734,375 and 3,735,908. The machine 20 illustratively includes a machine housing 21, a cylindrical housing 22, a projectible member 23 which holds a needle 24, and a movable jaw 25. High pressure air is supplied to cylindrical housing 22 by an air line 53, as regulated by a control module 57. Cylindrical housing 22 contains mechanisms, as disclosed for example in the above-cited patents, which cause the lowering of movable jaw 25 and projectible member 23. The projectable member 23 moves telescopically out of the cylindrical housing 22 when air pressure is applied. The cylindrical housing 22 is fixed to the machine housing 21 and the application of air pressure within the cylindrical housing 22 causes the projectable member 23 to move telescopically out of the cylindrical housing 22. Movable jaw 25 contains a hole **25*h* which permits the passage of needle 24**. Also disclosed are internal means for causing the expulsion of an attachment member through a slot in the needle.

The above attaching device is well suited to the task of compressing layers of material and similar items in order to allow penetration by the needle 24 and the release of an attachment member. Also necessary for this purpose is a second jaw, anvil, or other suitable opposing member (of. FIG. 26 in U.S. Pat. No. 3,734,375) in order that the workpiece may be compressed during the fastening process. The attaching assembly of the invention incorporates a structure enabling the processing of dense materials, while minimizing the risk of fracturing an attachment member.

With further reference to FIG. 3, the attaching assembly includes a receiver cylinder 30 and an air cylinder 40, located on a common vertical line with fastener inserting machine 20. Air cylinder 40 contains a piston (not shown) which is coupled to receiver cylinder 30, so that the introduction of an air impulse through an air line 51 lifts the receiver cylinder. After termination of the air pulse, the piston and receiver cylinder revert to the lower, idle position.

FIG. 4A, which shows a section of receiver cylinder 30 as seen from the side, reveals a cavity 35 of suitable dimensions to allow the insertion of needle 24. In the sectional plan view FIG. 4B of receiver cylinder 30, cavity 35 has a narrow oval profile. The cavity 35 is configured to allow the insertion of the needle 24, while limiting the rotation of the fastener attachment member around the axis of its filament after expulsion from the needle. This design for receiver cylinder 30 is particularly suited to the task of attaching display members such as those commonly known as "headers" to thick items, as can be seen with reference to the partial sectional view of FIG. 5. A layer 19' of thick material is surrounded by display members **17'*a* and 17'*b*, which include openings 18'a and 18'b which are provided to facilitate the entry of the needle 24 into and out of the layer 19'. Layer 19' and display members 17' are shown highly compressed between movable jaw 25 of inserting device 20, and receiver cylinder 30. The needle 24 has penetrated material 19' and display members 17', and is shown releasing one end 13*a* of attachment member 11, the site of release being the cavity 35 in receiver cylinder 30**.

In normal operation of the attaching assembly, following the release of attachment member 11, needle 24 will be retracted and movable jaw 25 will rise while receiver cylinder 30 drops. As it is generally desirable to bind layer 19' tightly with attachment member 11, the tendency of layer 19' to rapidly expand when freed from the confining jaws will result in considerable stress on the relatively short attachment member. During the process of inserting needle 24 through the compressed layers, the needle and attachment member 11 undergo significant stress, causing a bending of filament 12 by the folding of the filament 12 towards the end member **13*a*. When the projectable member 23 is in its uppermost position (e.g. as shown in FIG. 3) any attachment member 11 with an end 13*a* in the bore of the needle 24 has its associated filament projecting outwardly through a slot of the needle 24. As the needle 24 enters the material being compressed at the level of the filament 12, subsequent movement of the needle into the material bends the filament upwardly with the lower connection of the filament turned towards the end member 13*a* and the remaining length of the filament being pivotted upwardly against the length of the needle as shown in FIG. 5. This twisting, combined with the stress following ejection of the attachment member, might result in fracture of the attachment at the junction of one end 13 and the filament 12. When released within the confines of cavity 35, however, the end 13*a* of attachment 11 is naturally oriented along the long axis of that cavity (see FIG. 4B). This reorientation comes about because the release of the end member 13*a* from the bore of the needle 24 in the cavity 35 removes the force exerted by the interior bore of the needle against the end member and allows it to unfold and resume substantially the right angular position with respect to the filament illustrated in FIG. 1. It is this release of the bending force on the filament 11 that reduces the bending stress, and prevents fracture of the member 13*a* when the layer 19' is freed from the confining jaws 25 and 30. By orienting cavity 35 to restore attachment member 11** to its natural, untwisted state, the danger of fracture is significantly reduced.

Cavity 35 should have horizontal cross-sectional dimensions which take into account the dimensions of attachment member 11 as well as the thickness of the workpiece to be handled by the attaching assembly. As indicated in FIG. 4C, the receiver member 30 can also have a cavity 35 which is of essentially rectangular configuration as seen in a cross sectional plan of the cylinder transverse to the direction of motion of the projecting member 23. In general the cavity 35 is of a relatively narrow oval configuration of dimensions which allow the insertion of the needle 24 while limiting the rotation of the fastener attachment member 11 around the axis of its filament 12 after expulsion from the needle 24. It is desirable to provide a certain surplus over the dimensions of an end 13, although the narrower dimension of cavity 35 must be smaller than the length of end 13. A greater surplus is needed when processing thicker materials.

Mounting assembly 60 advantageously is of a sturdy design in order to resist the torque which is naturally exerted upon the fastener dispensing device 20 during repeated attaching operations.

While various aspects of the invention have been set forth by the drawings and the specifications, it is to be understood that the foregoing detailed description is for illustration only and that various changes in parts, as well as the substitution of equivalent constituents for those shown and described, may be made without departing from the spirit and scope of the invention as set forth in the appended claims.

We claim:

1. An improved fastener insertion assembly of the type including a needle containing a slot through which a portion of a fastener attachment member may be forced and expelled, said fastener attachment member having two ends connected by a thin filament; means for telescoping said needle out of a housing along a projection axis; first and second clamping means for engaging a workpiece through which the fastener attachment member is to be inserted, said first and second clamping means being formed to admit the passage of said needle and said first clamping means being movable in the direction of said needle; and means for projecting said first clamping means along said projection axis, in which the improvement comprises second clamping means comprising a receiver member containing a cavity, said cavity being configured to allow the insertion of said needle while limiting the rotation of the fastener attachment member around the axis of its filament after expulsion from the needle.

2. A fastener insertion assembly in accordance with claim 1 further comprising means for projecting said receiver member along said projection axis toward the first clamping means.

3. A fastener insertion assembly in accordance with claim 2 wherein said first clamping means and said receiver member are simultaneously moved into proximity in order to clamp said workpiece.

4. Apparatus in accordance with claim 2 wherein the means for telescoping said needle, means for projecting said first clamping means, and means for projecting the receiver member are actuated by fluid impulses.

5. Apparatus in accordance with claim 1 wherein the cavity in said receiver member has a narrow rectangular cross-section transverse to said projection axis.

6. Apparatus in accordance with claim 1 wherein the cavity in said receiver member has a narrow oval cross-section transverse to said projection axis.

* * * * *